US007044674B2

(12) United States Patent
Dixon et al.

(10) Patent No.: US 7,044,674 B2
(45) Date of Patent: May 16, 2006

(54) MULTI PURPOSE HAND HELD CLEANING DEVICE

(76) Inventors: Marcia A. Dixon, 88 E. 46 St., Brooklyn, NY (US) 11203; Kenneth A. Tarlow, 21 Golden Hind Passage, Corte Madera, CA (US) 94925

( * ) Notice: Subject to any disclaimer, the term of this patent is extended or adjusted under 35 U.S.C. 154(b) by 0 days.

(21) Appl. No.: 10/955,502

(22) Filed: Oct. 1, 2004

(65) Prior Publication Data

US 2006/0072960 A1 Apr. 6, 2006

(51) Int. Cl.
*B43K 5/00* (2006.01)

(52) U.S. Cl. ..... 401/205; 401/27; 401/139; 401/263; 401/270; 15/119.2

(58) Field of Classification Search ..... 401/24, 401/25, 27, 136–140, 196, 205, 207, 261, 401/263, 268, 270; 15/116.1, 116.2, 119.1, 15/119.2

See application file for complete search history.

(56) References Cited

U.S. PATENT DOCUMENTS 5,097,561 A * 3/1992 Torres ..... 15/119.2
5,865,551 A * 2/1999 Lalli et al. ..... 401/139
6,146,041 A * 11/2000 Chen et al. ..... 401/140
6,217,244 B1 * 4/2001 Chen et al. ..... 401/140

* cited by examiner

*Primary Examiner*—Justine R. Yu
*Assistant Examiner*—Huyen Le
(74) *Attorney, Agent, or Firm*—Michael Shippey

(57) ABSTRACT

Multi purpose hand held cleaning device comprising a gun shaped handle portion, a first tubular portion perpendicularly attached at one end to the handle portion, a U shaped frame attached at the opposite end, the legs of the U frame terminating in transverse roller bearings, a second hollow tube placed concentrically inside the first hollow tube, one end of the second hollow tube terminating in a sponge member, the first hollow tube having a slot so that a trigger member attached to the second hollow tube can slidably fit within the slot, the second hollow tube enclosing a compression spring. A preferred embodiment includes the handle being hollow so as to be capable of retaining a cleaning fluid and an internal fluid pump activated by an external trigger member.

6 Claims, 4 Drawing Sheets

MULTI PURPOSE HAND HELD CLEANING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable cleaning devices and more specifically to a multi purpose hand held cleaning device.

Many types of cleaning tools and devices are available in the consumer market today for the purpose of cleaning surfaces such as floors, counters, windows and other surfaces commonly found in homes and offices. Cleaning tools include sponges, brushes, scrubbing pads, window cleaning squeegees and paper towels.

Within the last forty years the sponge mop has evolved as a floor care cleaning device. Many sponge mops include mechanisms to squeeze fluid out of the sponge. Additionally, window cleaning systems have evolved to include rubber squeegees and window cleaning fluids. Finally, various plastic filament pad type scrubbers have been introduced to the market.

However, there has not existed, a hand held cleaning device that includes a mini sponge mop, a squeegee, a cleaning fluid reservoir and pump means for executing cleaning fluid in the direction of a window, as well as a scrubbing pad. A hand held mini sponge mop can come in handy to spot clean floor or counter surfaces. Additionally, a mini sponge mop can be used to soak up spills quickly. A carrying case that opens to form a double pan can act to store cleaning fluid in one half and to receive waste water from the wrung out sponge in the other half so that cleaning activities can be executed at locations that are not near a water source or a drain.

BRIEF SUMMARY OF THE INVENTION

The primary object of the invention is to provide a hand held cleaning device that includes a sponge portion which can be wrung out automatically when a trigger is pulled.

Another object of the invention is to provide a hand held cleaning device that includes a squeegee for window cleaning.

Another object of the invention is to provide a hand held cleaning device that includes a liquid cleaning reservoir and a means for ejecting the liquid onto a surface.

A further object of the invention is to provide a hand held cleaning device that includes an abrasive scrubbing member.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a multi purpose hand held cleaning device comprising: a gun shaped handle portion, a first hollow tubular portion perpendicularly attached at its first end to the top of said handle handle portion, a U shaped frame attached the second opposite end of said tubular portion, the top of the legs of said U frame terminating in transverse roller bearings, a second hollow tube placed concentrically inside said first hollow tube, one end of said second hollow tube terminating in a transversely placed sponge member, said first hollow tube having a longitudinally displaced slot so that a trigger member fixidly attached to said second hollow tube can slidably fit within said slot, said second hollow tube enclosing a compression spring, said spring retained at its far end by an end cap attached to said first hollow tube.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Figure 1:
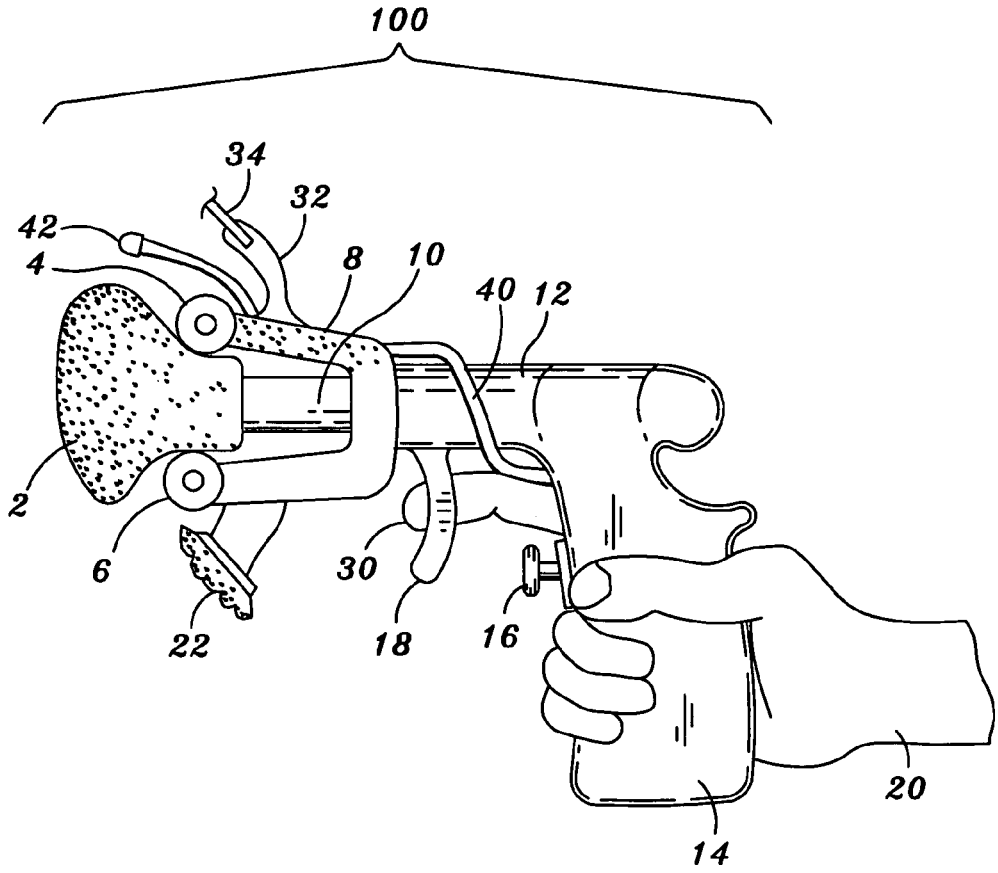
FIG. 1 is a side view of the present invention.
Figure 2:
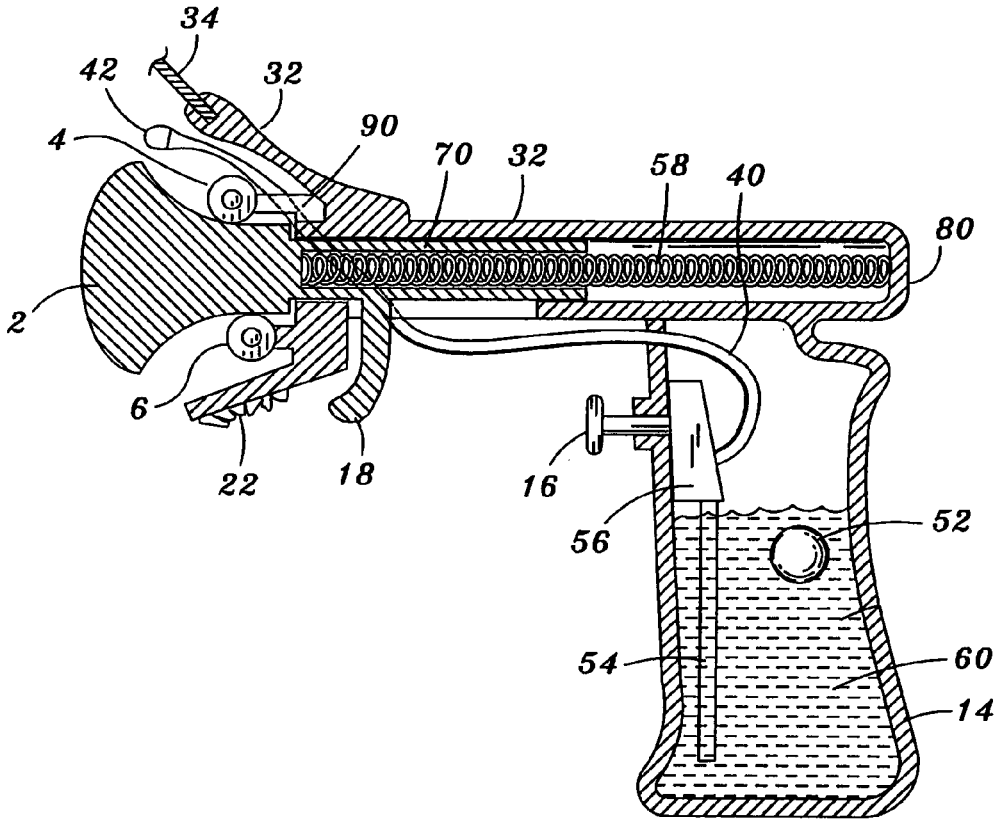
FIG. 2 is a side section view of the present invention.

FIG. 1 is a side view of the invention 100. A person's hand 20 is holding the hand grip portion 14 of the invention 100. The person's forefinger 30 is set to activate trigger 18 which can pull back sponge portion 2 so that rollers 4, 6 cause the sponge 2 to be compressed and thereby wrung out in a similar fashion to a standard sponge mop. A scrubbing pad 22 is positioned under the sponge 2 so that the user can scrub away debris that can not be loosened by the sponge 2. A squeegee support member 32 supports a squeegee 34 that is located above the sponge member 2. An additional trigger 16 can be activated by the user's finger 30 which causes fluid contained inside the hollow grip portion 14 to be pumped out and through tube 40 so that it exits out of the end of tube 40 at point 42. In this way a person can use the present invention 100 as a mini sponge mop to clean small areas or absorb spills, or the user can employ the invention 100 to squirt cleaning fluid onto a surface such as a window and to use the squeegee 34 to remove excess dirt and water from the window. FIG. 2 shows a side section view of the present invention 100. In this view we can see that the handle portion 14 is hollow and can receive cleaning fluid 60 through removable cap 52. The handle 14 also includes a fluid pump 56 that is activated by trigger 16 so that cleaning fluid can be drawn through tube 54 and pumped through tube 40 and exit at point 42. Trigger 18 is attached to slidable hollow tube 70. Sponge member 2 is fixedly and transversely attached to the end of tube 70. Rollers 4, 6 are attached to U shaped frame member 90 so that when the user pulls back on trigger 18, the sponge member 2 is caused to compress between the rollers 4, 6 thereby wringing out the sponge. A compression spring is situated inside hollow tube 70 and retained by end cap 80 so that when a user pulls back on trigger 18 and then releases the trigger, the sponge member 2 is automatically expelled outward for re-use. Squeegee 34 and squeegee holding member 32 can also be clearly seen.

Figure 3:
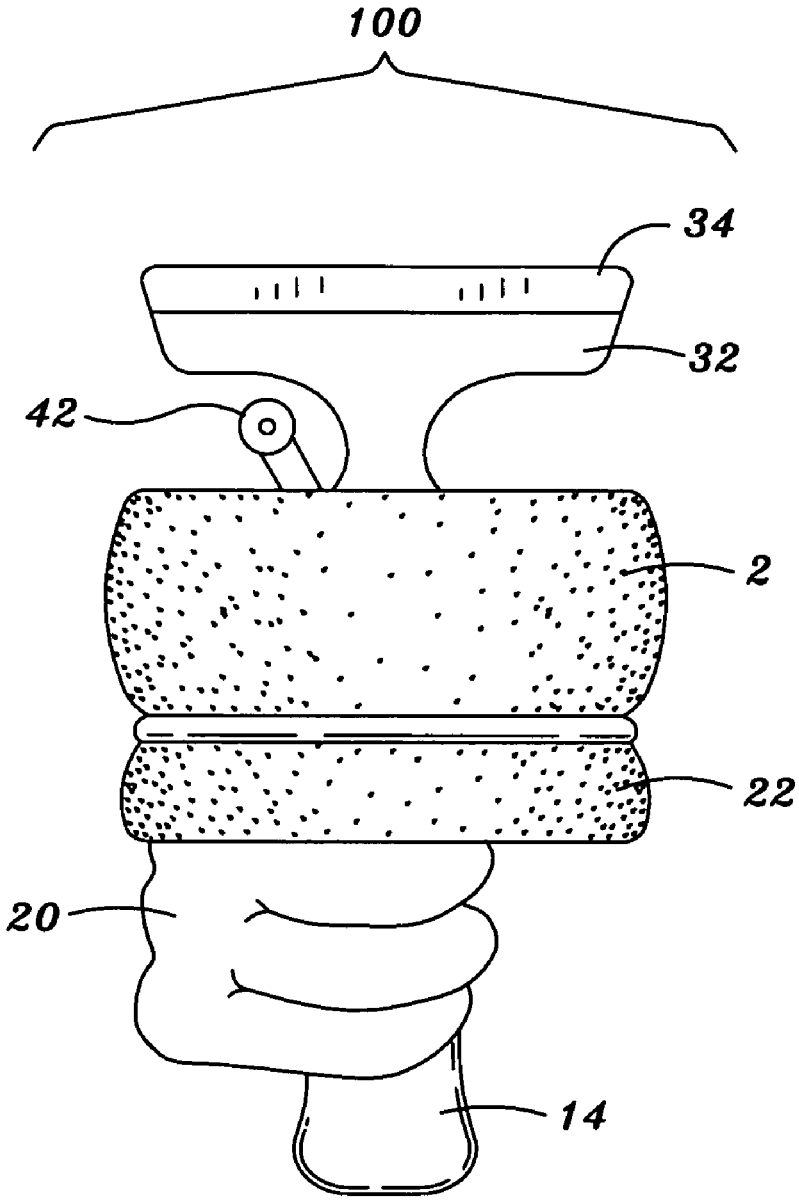
FIG. 3 is a front view of the present invention.
Figure 4:
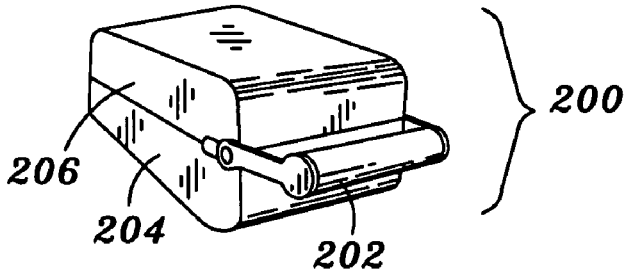
FIG. 4 is a perspective view of the case of the invention in the closed position.
Figure 5:
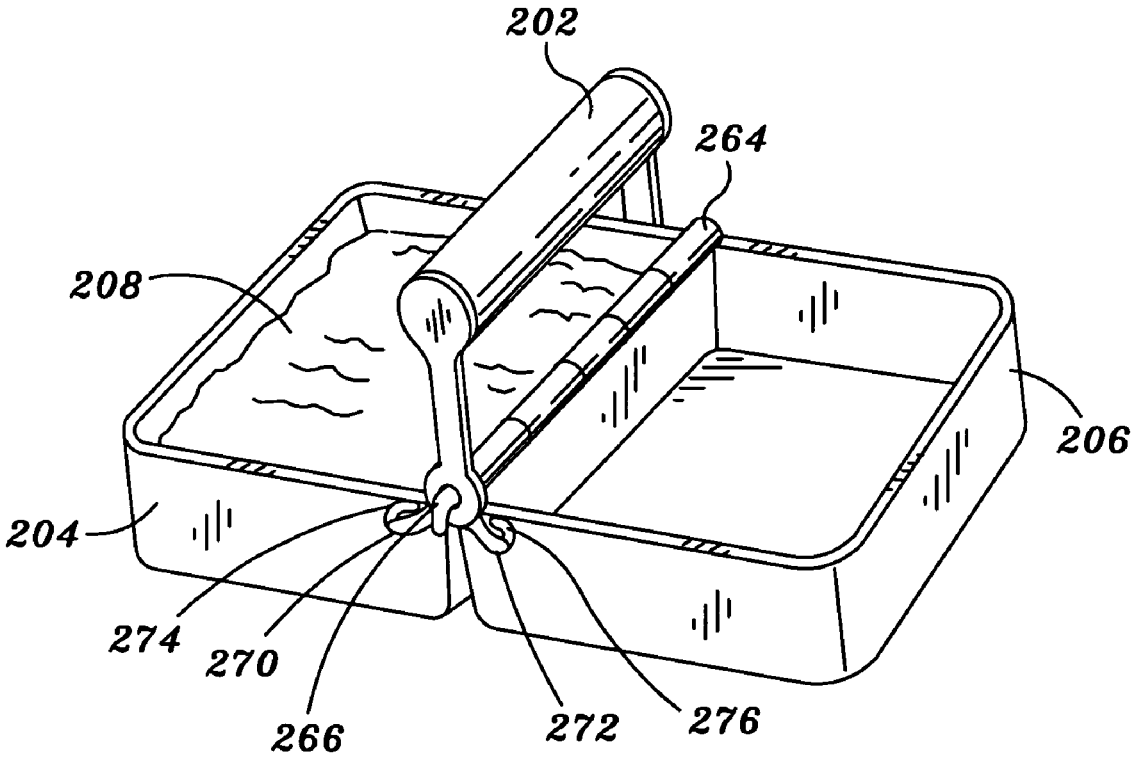
FIG. 5 is a perspective view of the case of the invention in the open position.

FIG. 3 shows a front view of the invention 100. In this view we can clearly see the relationship between squeegee 34, fluid exit point 42, sponge member 2 and scrubber member 22. FIG. 4 shows a perspective view of a carry case 200 that can retain the invention 100. The case includes two halves 204, 206 and a carry handle 202. FIG. 5 shows a perspective view of the carry case in the open position. Case half 204 can be filled with cleaning solution or water 208 and case half 206 can receive fluid that is wrung out from the sponge 2 so that the user can execute a cleaning activity at a remote location that is not close to a water source or a drain. Hinge 264 allows the case 200 to fold open and closed. The J shaped portion 266 at the end of the hinge pin allows the handle 202 to be temporarily removed during the case opening and closing process. Wings 270, 272 are retained by posts 274, 276 so that the case halves stay perpendicular to the handle 202 regardless of the weight of fluid retained in each case half.

What is claimed is:

1. Multi purpose hand held cleaning device comprising:

a gun shaped handle portion;

a first hollow tubular portion perpendicularly attached at its first end to the top of said handle handle portion;

a U shaped frame member attached the second opposite end of said first tubular portion;

the top of the legs of said U frame terminating in transverse roller bearings;

a second hollow tube placed concentrically inside said first hollow tube;

one end of said second hollow tube terminating in a transversely placed sponge member;

said first hollow tube having a longitudinally displaced slot so that a trigger member fixidly attached to said second hollow tube can slidably fit within said slot;

said second hollow tube enclosing a compression spring;

said spring retained at its far end by an end cap attached to said first hollow tube.

2. Multi purpose hand held cleaning device as claimed in claim 1 further comprising the said handle being hollow so as to be capable of retaining a cleaning fluid;

said handle also including a removable cap for filling said handle with said fluid;

said handle also including an internal fluid pump that is activated by an external trigger member and a flexible tube traveling from the output orifice of said pump to a position slightly above said sponge member.

3. Multi purpose hand held cleaning device as claimed in claim 1 further comprising a transverse squeegee member the base of which is mounted to the top of said U shaped member and extending upward at an angel so that the squeegee portion is located just above and parallel to said transverse sponge member.

4. Multi purpose hand held cleaning device as claimed in claim 1 further comprising an abrasive scrubbing pad mounted to the lower portion of said U shaped member.

5. Multi purpose hand held cleaning device as claimed in claim 1 wherein said cleaning device can be grasped by the hand of a user who can wet the sponge member and clean a surface, then wring out said sponge member by pulling back on said trigger located on said second hollow tube thereby causing said sponge member to be compressed by said transverse rollers thereby forcing liquid from said sponge and said sponge returning to the start position automatically by the action of said compression spring.

6. Multi purpose hand held cleaning device as claimed in claim 1 wherein said hand held cleaning device can be removably retained in a storage case;

said storage case being comprised of two halves so that when opened, one half can be filled with clean water or cleaning fluid and the second half can accept dirty water that has been wrung from said sponge so that the user can participate in remote cleaning activities and have a place to store clean water and dirty water until the job is complete and said case halves can be emptied into a standard drain.

* * * * *